US011423857B2

(12) United States Patent
Tang et al.

(10) Patent No.: US 11,423,857 B2
(45) Date of Patent: Aug. 23, 2022

(54) SIGNAL COMPENSATION SYSTEM AND SIGNAL COMPENSATION METHOD

(71) Applicant: HKC CORPORATION LIMITED, Shenzhen (CN)

(72) Inventors: Li Tang, Shenzhen (CN); Haijiang Yuan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/367,335

(22) Filed: Jul. 3, 2021

(65) Prior Publication Data

US 2022/0084480 A1 Mar. 17, 2022

(30) Foreign Application Priority Data

Sep. 16, 2020 (CN) ..... 202010978027.3

(51) Int. Cl.
*G09G 3/36* (2006.01)

(52) U.S. Cl.
CPC ..... *G09G 3/3648* (2013.01); *G09G 2310/08* (2013.01)

(58) Field of Classification Search
CPC ..... G09G 3/3648; G09G 2310/08
See application file for complete search history.

(56) References Cited

U.S. PATENT DOCUMENTS

2005/0139829 A1 6/2005 Lee
2009/0244109 A1* 10/2009 Chen ..... G09G 3/3648 345/690
2018/0268753 A1* 9/2018 Wang ..... G09G 3/2011

FOREIGN PATENT DOCUMENTS

| | | | | |
|---|---|---|---|---|
| CN | 1779774 | A | | 5/2006 |
| CN | 101192387 | A | | 6/2008 |
| CN | 102005185 | A | | 4/2011 |
| CN | 104867449 | A | * | 8/2015 |
| CN | 105575350 | A | | 5/2016 |
| CN | 105575352 | A | | 5/2016 |
| CN | 105609073 | A | | 5/2016 |
| CN | 106128402 | A | | 11/2016 |
| CN | 106652966 | A | | 5/2017 |
| CN | 109119039 | A | | 1/2019 |
| CN | 109473075 | A | | 3/2019 |

OTHER PUBLICATIONS

First Office Action issued in counterpart Chinese Patent Application No. 202010978027.3, dated May 25, 2021.

* cited by examiner

*Primary Examiner* — Sahlu Okebato
(74) *Attorney, Agent, or Firm* — Westbridge IP LLC

(57) ABSTRACT

The present application provides a signal compensation system, which includes a level conversion module, a determination module and a compensation module. The level conversion module is for receiving a timing signal and converting the timing signal into a control signal. The determination module is for detecting a target row number of a gate corresponding to the control signal and determining a compensation coefficient according to the target row number. The compensation module is for compensating an output voltage of the control signal according to the compensation coefficient, thereby voltages at gates are consistent when the control signal is sent to each of the gates. The present application also provides a signal compensation method.

4 Claims, 6 Drawing Sheets

SIGNAL COMPENSATION SYSTEM AND SIGNAL COMPENSATION METHOD

CROSS REFERENCE TO RELATED APPLICATIONS

The present application claims priority to Chinese patent application No.202010978027.3, filed on Sep. 16, 2020 with the China National Intellectual Property Administration, entitled "Signal Compensation System and Signal Compensation Method", the entirety content of which is incorporated herein by reference.

TECHNICAL FIELD

The present application relates to a liquid crystal display technology field, particularly relates to a signal compensation system and signal compensation method.

BACKGROUND

With the widespread application of liquid crystal displays in the display field, various liquid crystal display manufacturers have increasingly strict requirements on the display quality and production cost of liquid crystal displays. Array substrate gate drive technology (GOA technology, Gate Driver on Array) is the array substrate row drive technology. Gate drive circuits (Gate Driver ICs) are directly formed on the array substrate. The drive circuits of the horizontal scan lines can be formed on the substrate around the display area by applying the array process of liquid crystal display panel, so that it can replace the external IC to drive the horizontal scan lines. The GOA technology can reduce the bonding process of external ICs, such that it has an opportunity to increase production capacity and reduce the production cost, and it can make liquid crystal display panels more suitable for display products with narrow bezels. Currently, the GOA technology has been widely used in liquid crystal display panels. Based on this, narrow bezels have also become one of the pursuits of various panel manufacturers.

In the gate drive process of the GOA technology, the timing controller (TCON) provides the level conversion module (L/S) with timing signals of a frame start signal (STV), row clock signal (CKV) and low frequency signal (LC). After processed by the L/S, the timing signals are transformed into control signals. The control signals are transmitted to gates on both sides of the substrate via a drive circuit and wires. Due to the wires connecting the drive circuit with each of the gates on the substrate have inconsistent lengths, thus the impedances of the wires are different, and after the control signals output by the L/S reach the corresponding gates, their drive capabilities are inconsistent, and finally horizontal stripes may appear on the picture.

SUMMARY

A main purpose of the present application provides a signal compensation method, aiming at solving a technical problem in related art that the drive capabilities of the drive circuits connecting gates of the substrate are inconsistent.

In order to realize the above-mentioned purpose, the present application provides a signal compensation system, including a level conversion module, a determination module and a compensation module;

the level conversion module for receiving a timing signal and converting the timing signal into a control signal;

the determination module for detecting a target row number of a gate corresponding to the control signal and determining a compensation coefficient according to the target row number; and the compensation module for compensating an output voltage of the control signal according to the compensation coefficient, thereby voltages at gates are consistent when the control signal is sent to each of the gates.

In one embodiment, the compensation module comprises: a calculation unit and a compensation unit; the calculation unit for calculating a compensated output voltage according to the compensation coefficient and an output voltage of a preset row; the compensation unit for sending the compensated output voltage to a corresponding gate.

In one embodiment, the determination module comprises: a detection unit and a judgment unit; the detection unit for detecting a total number of rows of the gates and determining the preset row according to the total number of rows; the judgment unit for judging an adjustment state of the control signal according to the target row number and the preset row number and adjusting the compensation coefficient according to the adjustment state.

In one embodiment, the judgment unit is also for judging that the adjustment state is to increase when the target row number is larger than the preset row number; judging that the adjustment state is to decrease when the target row number is less than the preset row number.

In one embodiment, the judgment unit is also for taking a first coefficient greater than 1 as the compensation coefficient when judging that the adjustment status is to increase; taking a second coefficient less than 1 as the compensation coefficient when judging that the adjustment status is to decrease.

Furthermore, in order to realize the above-mentioned purpose, the present application provides a signal compensation method, including:

receiving a timing signal and converting the timing signal into a control signal;

detecting a target row number of a gate corresponding to the control signal;

determining a compensation coefficient according to the target row number; and compensating an output voltage of the control signal according to the compensation coefficient, thereby voltages at gates are consistent when the control signal is sent to each of the gates.

In one embodiment, the step "compensating an output voltage of the control signal according to the compensation coefficient, thereby voltages at gates are consistent when the control signal is sent to each of the gates" comprises:

calculating a compensated output voltage according to the compensation coefficient and an output voltage of a preset row;

sending the compensated output voltage to a corresponding gate.

In one embodiment, the step "determining a compensation coefficient according to the target row number" comprises:

detecting a total number of rows of the gates and determining the preset row according to the total number of rows;

judging an adjustment state of the control signal according to the target row number and the preset row number; and adjusting the compensation coefficient according to the adjustment state.

In one embodiment, the step "judging an adjustment state of the control signal according to the target row number and the preset row number" comprises:

judging that the adjustment state is to increase when the target row number is larger than the preset row number; and judging that the adjustment state is to decrease when the target row number is less than the preset row number.

In one embodiment, the step "determining a compensation coefficient according to the target row number" comprises:

taking a first coefficient greater than 1 as the compensation coefficient when judging that the adjustment status is to increase; and taking a second coefficient less than 1 as the compensation coefficient when judging that the adjustment status is to decrease.

After the level conversion module converts the timing signal sent by the timing controller into the control signal, the technical solution of the present application adjusts the output voltage at the drive circuit, which sends the control signal, by the compensation module after the level conversion module converting the timing signal sent by the timing controller into a control signal. When the wire between the drive circuit and the gate is longer, that is, the impedance value is higher, the output voltage is increased to offset the impedance. When the wire between the drive circuit and the gate is shorter, that is, the impedance value is lower, the output voltage is decreased to compensate the impedance. In such way, the voltages at the gates are consistent when the control signal reaches each of the gates, thereby ensuring that the drive capability of the control signal on the each of the gates is consistent, thereby improving the display quality of the liquid crystal display compensated.

BRIEF DESCRIPTION OF THE DRAWINGS

For more clearly illustrate the technical solutions in the embodiments of the present application or the related art, the drawing figures required to use in the description of the embodiments or the related art will be simply introduced as below. Obviously, the drawings described as below are merely some embodiments of the present application. For one of ordinary skill in the art, other drawings can be obtained based on the structures shown in those drawings without creative work.

The realization of the purposes, functional characteristics, and advantages of the present application will be further described in conjunction with the embodiments and with reference to the accompanying drawings.

DETAILED DESCRIPTION OF THE EMBODIMENTS

The technical solutions in the embodiments of the present application will be clearly and completely described in conjunction with the drawings in the embodiments of the present application as below. Obviously, the described embodiments are only a portion of the embodiments of the present application, rather than all the embodiments. Based on the embodiments in the present application, all other embodiments obtained by one of ordinary skill in the art without any creative work shall fall within the protection scope of the present application.

It should be noted that all directional indications (such as up, down, left, right, front, back . . . ) in the embodiments of the present application are only set to explain the relative position relationship, movement situation, etc. between components in a specific posture (as shown in the accompanying drawings). If the specific posture changes, the directional indication will change accordingly.

In addition, the description of "first", "second", etc. involved in the embodiments of the present application are only set for descriptive purposes, and cannot be understood as indicating or implying their relative importance or implicitly indicating a number of indicated technical features. Therefore, the features defined with "first", "second" may explicitly or implicitly include at least one of the features. In addition, the technical solutions between the various embodiments can be combined with each other, but must be based on what can be achieved by one of ordinary skill in the art. When a combination of technical solutions is contradictory or cannot be achieved, it should be considered that such a combination of technical solutions does not exist, and is not within the protection scope required by the present application.

Figure 6:
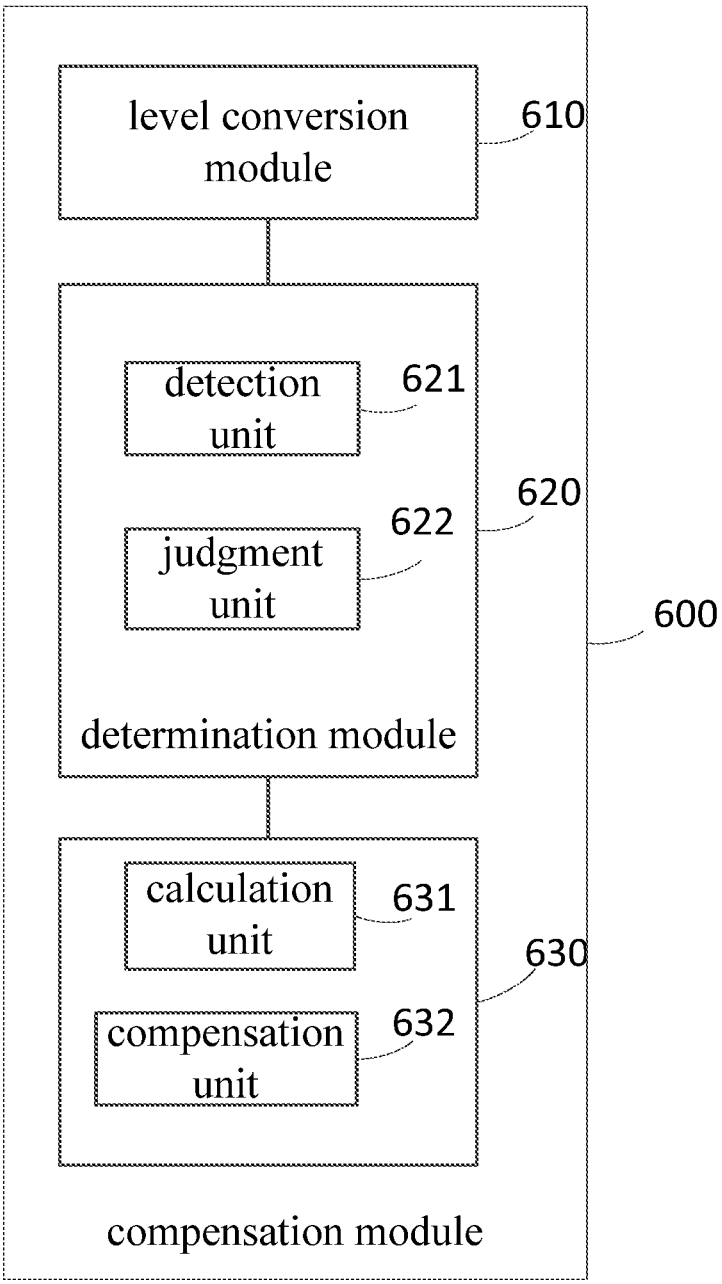
FIG. 6 is a schematic structural diagram of a compensation system of the present application.

Referring to FIG. 6, the present application provides a signal compensation system 600 which includes a level conversion module 610, a determination module 620 and a compensation module 630. The level conversion module 610 is for receiving a timing signal and converting the timing signal into a control signal. The determination module 620 is for detecting a target row number of a gate corresponding to the control signal and determining a compensation coefficient according to the target row number. The compensation module 630 is for compensating an output voltage of the control signal according to the compensation coefficient, thereby voltages at gates are consistent when the control signal is sent to each of the gates.

In the gate drive process of GOA technology, it generally includes a drive circuit, a timing controller, a level conversion module and a thin film gate substrate. An input terminal of the timing controller is connected with an external power source. An output terminal of the timing controller is connected with an input terminal of the level conversion module. The timing controller provides the level conversion module with the timing signal. The timing signal specifically includes a frame start signal (STV), a row clock signal (CKV) and a low frequency signal (LC). The level conversion module is for converting the timing signal output by the timing controller into the control signal. The control signal specifically includes a HC control signal whose high level is VGH and low level is VGL, and a LC control signal whose high level is VGH and low level is VGL, and a STV control signal whose high level is VGH and low level is VGL. The level conversion module transmits the converted control signal to each of the gates of the thin film gate substrate via the drive circuit and wires, thereby realizing the display of pictures.

In practical applications, based on different resolutions of display screens, the thin film gate substrate usually includes a different number of rows, and each of the rows of the thin film gate substrate is provided with a gate correspondingly.

The determination module 620 determines a target gate to which the control signal needs to be transmitted, and obtains a target row number corresponding to the target gate, thereby determining the target row number.

In order to make the voltages at the gates be consistent when the control signal reaches each of the gates, a compensation coefficient or a compensation function is correspondingly set according to each row number. After determining the target row number, the determination module 620 determines or calculates a corresponding compensation coefficient by a mean of looking up a table or mapping in the table, or according to the compensation function and the target row number, and the determination module 620 sends the compensation coefficient to the compensation module 630.

An output terminal of the compensation module 630 is respectively connected with a plurality of gates of the thin film gate substrate through the drive circuit. The compensation module 630 calculates a compensated output voltage of the control signal according to the compensation coefficient and compensates an output voltage of the control signal, so that voltages output by the compensation module 630 to each of the gates are consistent. During a process of the drive circuit sending the control signal to each of the gates, the output voltage of the control signal is compensated by the compensation module 630. When the wire between the driving circuit and the gate is longer, that is, an impedance value is higher, the output voltage is increased to offset the impedance. When the wire between the driving circuit and the gate is shorter, that is, the impedance value is lower, the output voltage is decreased to compensate the impedance. In this way, the voltages at the gates are consistent when the control signal reaches each of the gates.

According to the technical solution of the present application, after the level conversion module converts the timing signal sent by the timing controller into the control signal, the compensation module 630 adjusts the output voltage at the drive circuit, which sends the control signal. When the wire between the drive circuit and the gate is longer, that is, the impedance value is higher, the output voltage is increased to offset the impedance. When the wire between the drive circuit and the gate is shorter, that is, the impedance value is lower, the output voltage is decreased to compensate the impedance. In such way, the voltages at the gates are consistent when the control signal reaches each of the gates, thereby ensuring that the drive capability of the control signal on the each of the gates is consistent, thereby improving the display quality of the liquid crystal display compensated.

Further, the compensation module 630 includes a calculation unit 631 and a compensation unit 632. The calculation unit 631 is for calculating a compensated output voltage according to the compensation coefficient and an output voltage of a preset row. The compensation unit 632 is for sending the compensated output voltage to a corresponding gate. After receiving the compensation coefficient, the calculation unit calculates the compensated output voltage of the control signal according to the compensation coefficient, and sends a calculation result of the compensated output voltage to the compensation unit. The compensation unit sends the compensated output voltage to the corresponding gate. Specifically, the compensated output voltage is a product of the output voltage of the preset row number and the compensation coefficient. It can be understood that values of the target row numbers present a change trend same as that of the compensation coefficient. When the value of the target row number is larger, it means that the wire between the drive circuit and the gate corresponding to the target row number is longer, the impedance is higher, then the compensation coefficient is increased as moving to a row of a higher row number, thereby ensuring that the voltages at the gates are consistent when the control signal reaches each of the gates.

It should be noted that the present application includes but is not limited to the above solutions. In another embodiment, when the value of the target row number is larger, it means that the wire between the driving circuit and the corresponding gate is shorter, that is, the impedance value is lower, the compensation coefficient is inversely proportional to the value of the target row number, that is, it is only necessary to ensure that the compensation coefficient is proportional to the impedance value, thereby ensuring that the voltages at the gates are consistent when the control signal reaches each of the gates.

In this embodiment, the compensation coefficients are mapped one by one to the gates corresponding to different row numbers, such that the output voltage to each of the rows is adjusted individually and accordingly without being affected among themselves, thereby improving the accuracy of the adjustment of the present application and further improving the display effect of the present application.

Further, the determination module 620 further includes a detection unit 621 and a judgment unit 622. The detection unit 621 is for detecting a total number of rows of the gates and determining the preset row according to the total number of rows. The judgment unit 622 is for judging an adjustment state of the control signal according to the target row number and the preset row number and adjusting the compensation coefficient according to the adjustment state.

After obtaining the total number of rows of the gates of the thin film gate substrate, the detection unit 621 takes a median value of the total number of rows as the preset row number and sends the preset row number to the judgment unit 622. After receiving the preset row number, the judgment unit 622 judges whether the target row number is lager than the preset row number. For example, when the preset row number is lager than the target row number, the judgment unit 622 judges that the adjustment state is to increase. When the preset row number is less than the target row number, the judgment unit 622 judges that the adjustment state is to decrease. Therefore, the judgment unit 622 can take the output voltage to the gate of the preset row number as a reference value, and the compensation module 630 adjusts output voltages of other row numbers to be equal to the output voltage of the preset row number.

In this embodiment, a thin film gate substrate with a total number of 768 rows is taken as an example, the 384th or 385th row is taken as the preset row number, and a corresponding compensation coefficient is set corresponding to each of rows 1-383 and rows 386-768, that is, the output voltages to gates of the 1-383th rows are decreased, and the output voltages to gates of the 386-768th rows are increased, so that their compensated output voltages are the same as the output voltage to the gates of the 384th or 385th row.

In this embodiment, a median of a total number of rows is set as the preset row number, and the output voltages to the gates of other rows are adjusted to be consistent with the output voltage to the gate of the preset row, so as to avoid the occurrence of problems such as an excessive compensation voltage causing damage to the drive circuit, or a too small compensation voltage causing failure of the control signal, thereby improving the stability of the present application.

Specifically, the judgment unit 622 is also for taking a first coefficient greater than 1 as the compensation coefficient when judging that the adjustment status is to increase, and taking a second coefficient less than 1 as the compensation coefficient when judging that the adjustment status is to decrease.

When the target row number is larger than the preset row number, it means that the wire between the drive circuit and the corresponding gate is longer, the impedance of the wire is higher, and the output voltage needs to be increased, that is, the compensation coefficient needs to be larger than 1, therefore, the first coefficient is taken as the compensation coefficient to perform the calculation. When the target row number is less than the preset row number, it means that the wire between the drive circuit and the gate is shorter, the impedance of the wire is lower, and the output voltage needs to be decreased, that is, the compensation coefficient needs to be less than 1, therefore, the second coefficient is taken as the compensation coefficient to perform the calculation. In this embodiment, the first coefficient and the second coefficient are respectively set to distinguish the compensation coefficient as an increase coefficient or a decrease coefficient, so as to avoid a phenomenon of misadjustment, and improve the stability of the present application.

Figure 1:
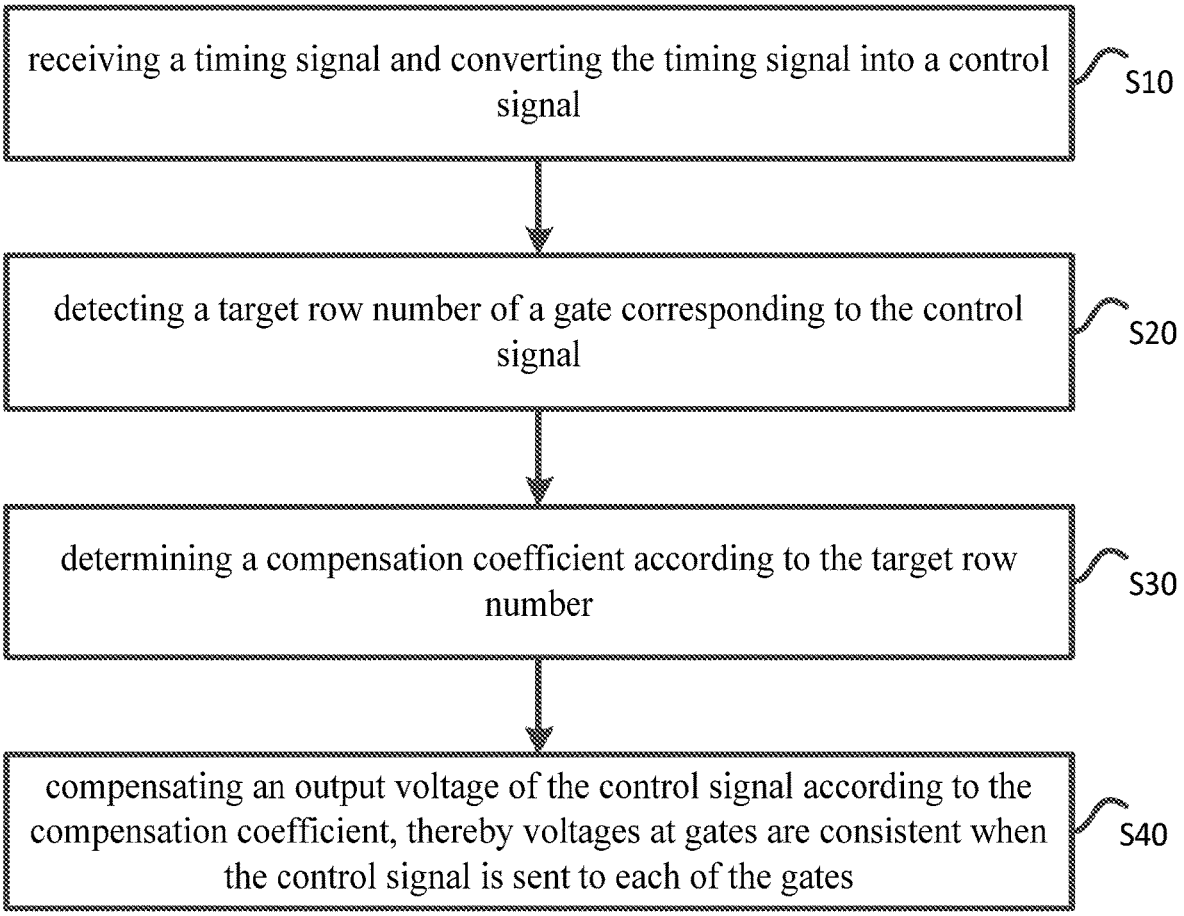
FIG. 1 is a flow diagram of a first embodiment of a compensation method the present application.

The present application also provides a signal compensation method, please refer to FIG. 1, FIG. 1 is flow diagram of a first embodiment of a compensation method the present application. The signal compensation method includes the following steps:

Step S10, receiving a timing signal and converting the timing signal into a control signal;

Step S20, detecting a target row number of a gate corresponding to the control signal;

Step S30, determining a compensation coefficient according to the target row number; and Step S40, compensating an output voltage of the control signal according to the compensation coefficient, thereby voltages at gates are consistent when the control signal is sent to each of the gates.

In the gate drive process of GOA technology, it generally includes a drive circuit, a timing controller, a level conversion module and a thin film gate substrate. An input terminal of the timing controller is connected with an external power source. An output terminal of the timing controller is connected with an input terminal of the level conversion module. The timing controller provides the level conversion module with the timing signal. The timing signal specifically includes a frame start signal (STV), a row clock signal (CKV) and a low frequency signal (LC).

The level conversion module is for converting the timing signal output by the timing controller into the control signal. The control signal specifically includes a HC control signal whose high level is VGH and low level is VGL, and a LC control signal whose high level is VGH and low level is VGL, and a STV control signal whose high level is VGH and low level is VGL. The level conversion module transmits the converted control signal to each of the gates of the thin film gate substrate via the drive circuit and wires, thereby realizing the display of the pictures.

In practical applications, based on different resolutions of display screens, the thin film gate substrate usually includes a different number of rows, and each of the rows of the thin film gate substrate is provided with a gate correspondingly. The determination module 620 determines a target gate to which the control signal needs to be transmitted, and obtains a target row number corresponding to the target gate, thereby determining the target row number.

An output terminal of the compensation module 630 is respectively connected with a plurality of gates of the thin film gate substrate through the drive circuit. The compensation module 630 calculates a compensated output voltage of the control signal according to the compensation coefficient and compensates an output voltage of the control signal, so that voltages output by the compensation module 630 to the gates are consistent. During a process of the drive circuit sending the control signal to each of the gates, the output voltage of the control signal is compensated by the compensation module 630. When the wire between the driving circuit and the gate is longer, that is, an impedance value of the wire is higher, the output voltage is increased to offset the impedance. When the wire between the driving circuit and the gate is shorter, that is, the impedance value of the wire is lower, the output voltage is decreased to compensate the impedance. In this way, the voltages at gates are consistent when the control signal reaches each of the gates.

According to the technical solution of the present application, after the level conversion module converts the timing signal sent by the timing controller into the control signal, the compensation module 630 adjusts the output voltage at the drive circuit, which sends the control signal. When the wire between the drive circuit and the gate is longer, that is, the impedance value of the wire is higher, the output voltage is increased to offset the impedance. When the wire between the drive circuit and the gate is shorter, that is, the impedance value of the wire is lower, the output voltage is decreased to compensate impedance. In such way, the voltages at the gates are consistent when the control signal reaches each of the gates, thereby ensuring that the drive capability of the control signal on the each of the gates is consistent, thereby improving the display quality of the liquid crystal display compensated.

Figure 2:
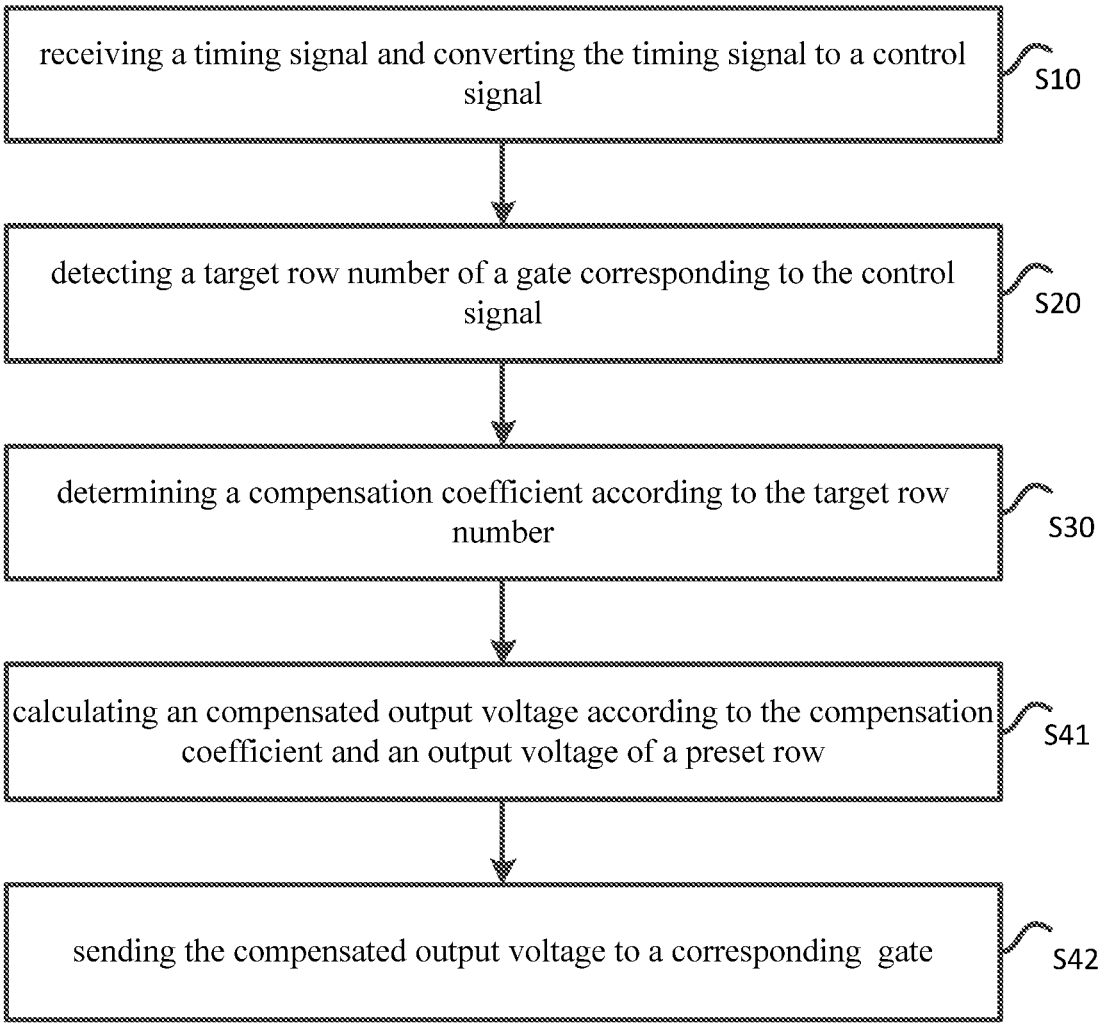
FIG. 2 is a flow diagram of a second embodiment of the compensation method of the present application.

Further, please refer to FIG. 2, FIG. 2 is a flow diagram of a second embodiment of the compensation method of the present application provided based on the first embodiment. The Step S40 specifically includes the following steps:

Step S41, calculating a compensated output voltage according to the compensation coefficient and an output voltage of a preset row;

Step S42, sending the compensated output voltage to a corresponding gate.

After receiving the compensation coefficient, the calculation unit calculates the compensated output voltage of the control signal according to the compensation coefficient, and sends a calculation result of the compensated output voltage to the compensation unit. The compensation unit sends the compensated output voltage to the corresponding gate. Specifically, the compensated output voltage is a product of the output voltage of the preset row number and the compensation coefficient. It can be understood that values of the target row numbers present a change trend same as that of the compensation coefficient. When the value of the target row number is larger, it means that a wire between the drive circuit and the gate corresponding to the target row number is longer, the impedance of the wire is higher, the compensation coefficient is increased as the moving to a row of higher row number, thereby ensuring that the voltages at the gates are consistent when the control signal reaches each of the gates.

It should be noted that the present application includes but is not limited to the above solutions. In another embodiment, when the value of the target row number is larger, it means that the wire between the driving circuit and the gate corresponding to the target row number is shorter, that is, the impedance value of the wire is lower, the compensation coefficient is inversely proportional to the value of the target row number, that is, it is only necessary to ensure that the compensation coefficient is proportional to the impedance value, thereby ensuring that the voltages at the gates are consistent when the control signal reaches each of the gates.

In this embodiment, the compensation coefficients are mapped one by one to the gates corresponding to different row numbers, such that the output voltage to each of the rows is adjusted individually and accordingly without being affected among themselves, thereby improving the accuracy of the adjustment of the present application and further improving the display effect of the present application.

Figure 3:
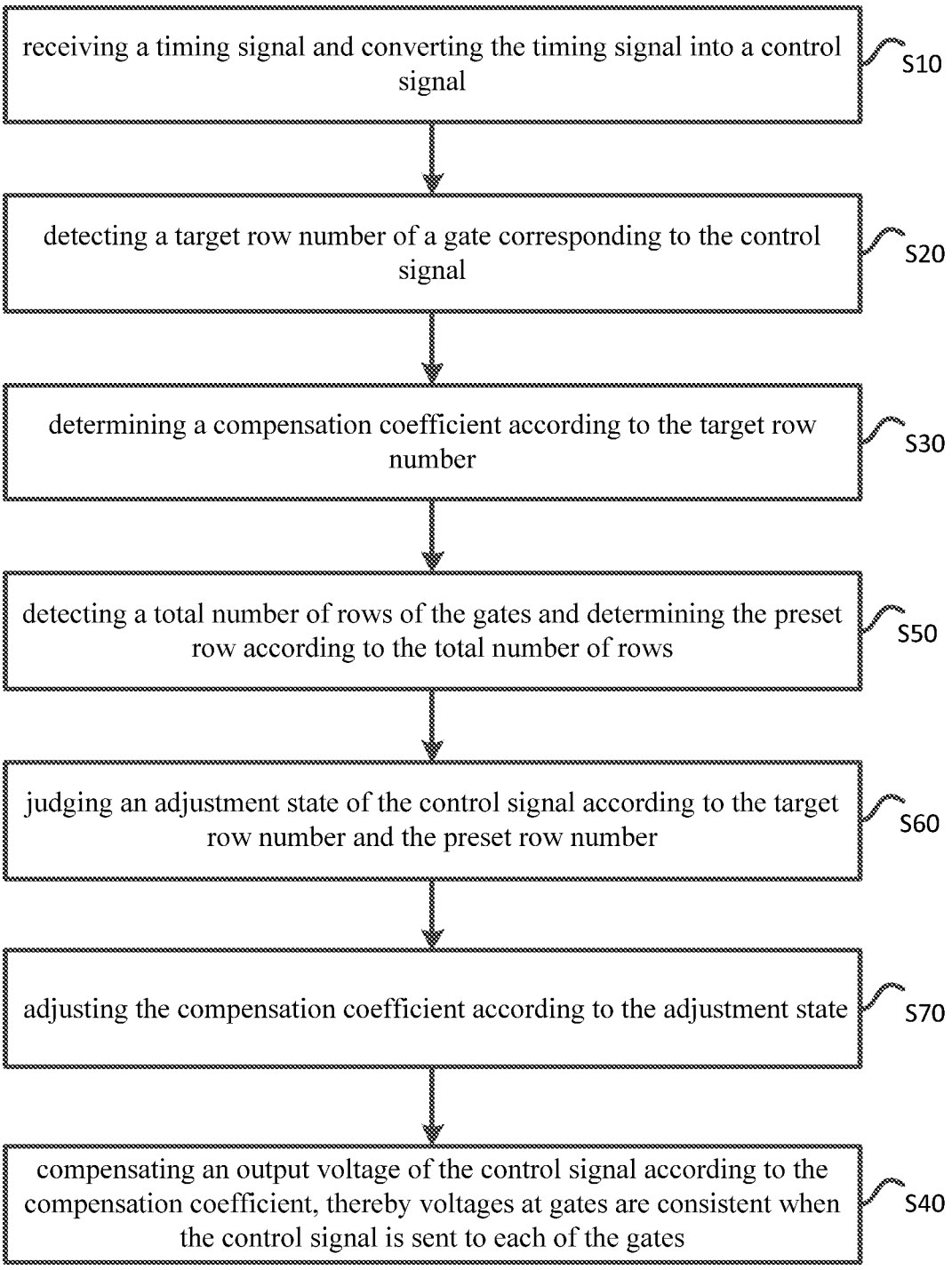
FIG. 3 is a flow diagram of a third embodiment of the compensation method of the present application.

Further, please refer to FIG. 3, FIG. 3 is a flow diagram of a third embodiment of the compensation method of the present application provided based on the second embodiment. After the Step S30, the method further includes the following steps:

Step S50, detecting a total number of rows of the gates and determining the preset row according to the total number of rows;

Step S60, judging an adjustment state of the control signal according to the target row number and the preset row number;

Step S70, adjusting the compensation coefficient according to the adjustment state.

The determination module 620 further includes a detection unit 621 and a judgment unit 622. After detecting the total number of rows of the gates on the thin film gate substrate, the detection unit 621 takes a median value of the total number of rows as the preset row number and sends the preset row number to the judgment unit 622. After receiving the preset row number, the judgment unit 622 judges whether the target row number is lager than the preset row number. For example, when the target row number is lager than the preset row number, the judgment unit 622 judges that the adjustment state is to increase. When the target row number is less than the preset row number, the judgment unit 622 judges that the adjustment state is to decrease. Therefore, the judgment unit 622 can take the output voltage to the gate of the preset row number as a reference value, and the compensation module 630 adjusts output voltages of other row numbers to be equal to the output voltage of the preset row number.

In this embodiment, a median of a total number of rows is set as the preset row number, and the output voltages to the gates of other rows are adjusted to be consistent with the output voltage to the gate of the preset row, so as to avoid the occurrence of problems such as an excessive compensation voltage causing damage to the drive circuit, or a too small compensation voltage causing failure of the control signal, thereby improving the stability of the present application.

Figure 4:
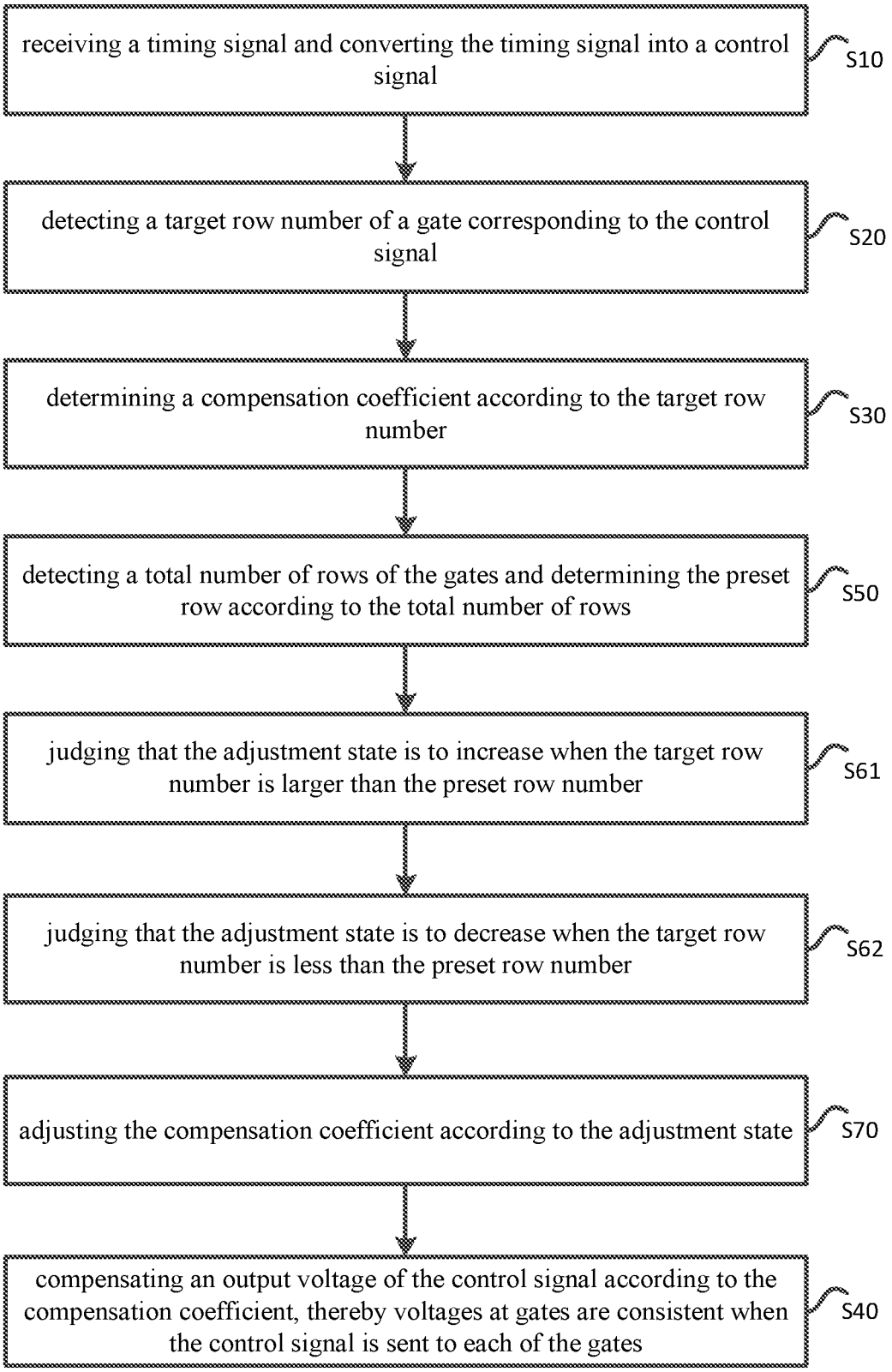
FIG. 4 is a flow diagram of a fourth embodiment of the compensation method of the present application.

Further, please refer to FIG. 4, FIG. 4 is a flow diagram of a fourth embodiment of the compensation method of the present application provided based on the third embodiment. The Step S60 includes the following steps:

Step S61, judging that the adjustment state is to increase when the target row number is larger than the preset row number;

Step S62, judging that the adjustment state is to decrease when the target row number is less than the preset row number.

In this embodiment, a thin film gate substrate with a total number of 768 rows is taken as an example, the 384th or 385th row is taken as the preset row number, and a corresponding compensation coefficient is set corresponding to each of rows 1-383 and rows 386-768, that is, the output voltages to gates of the 1-383th rows are decreased, and the output voltages to gates of the 386-768th rows are increased, so that their compensated output voltages are the same as the output voltage to the gates of the 384th or 385th row.

In this embodiment, a median of a total number of rows is set as the preset row number, and the output voltages to the gates of other rows are adjusted to be consistent with the output voltage to the gate of the preset row, so as to avoid the occurrence of problems such as an excessive compensation voltage causing damage to the drive circuit, or a too small compensation voltage causing failure of the control signal, thereby improving the stability of the present application.

Figure 5:
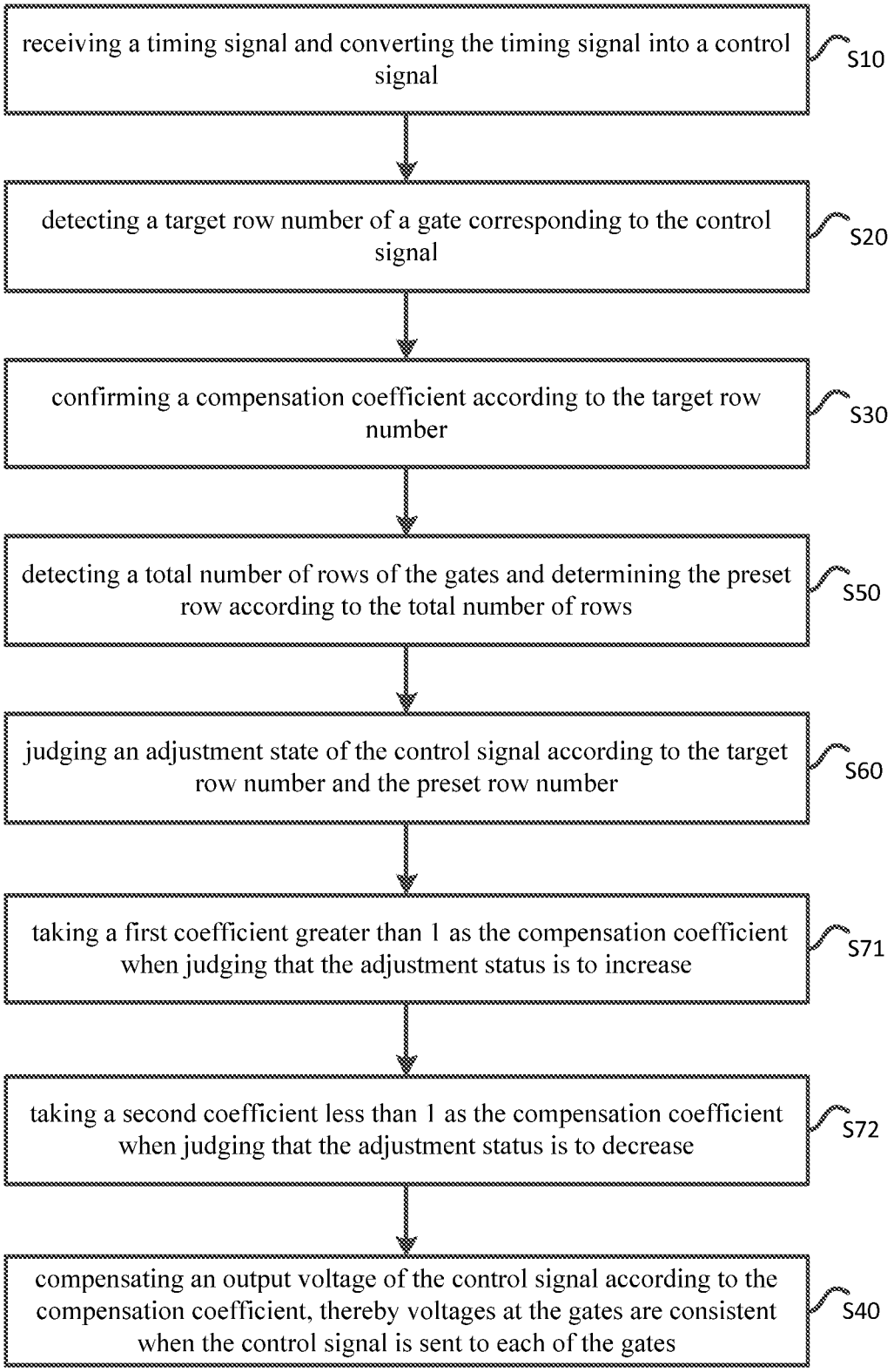
FIG. 5 is a flow diagram of a fifth embodiment of the compensation method of the present application.

Further, please refer to FIG. 5, FIG. 5 is a flow diagram of a fifth embodiment of a compensation method of the present application provided based on the fourth embodiment. The Step S70 includes the following steps:

Step S71, taking a first coefficient greater than 1 as the compensation coefficient when judging that the adjustment status is to increase;

Step S72, taking a second coefficient less than 1 as the compensation coefficient when judging that the adjustment status is to decrease.

When the target row number is larger than the preset row number, it means that the wire between the drive circuit and a corresponding gate is longer, the impedance of the wire is higher, and the output voltage needs to be increased, that is, the compensation coefficient needs to be larger than 1, therefore, the first coefficient is taken as the compensation coefficient to perform the calculation. When the target row number is less than the preset row number, it means that the wire between the drive circuit and the gate is shorter, the impedance of the wire is lower, and the output voltage needs to be decreased, that is, the compensation coefficient needs to be less than 1, therefore, the second coefficient is taken as the compensation coefficient to perform the calculation. In this embodiment, the first coefficient and the second coefficient are respectively set to distinguish the compensation coefficient as an increase coefficient or a decrease coefficient, so as to avoid a phenomenon of misadjustment, and improve the stability of the present application.

The above descriptions are only preferred embodiments of the present application, and do not limit the patent scope of the present application. Under the concept of the present application, the equivalent structure transformations made by using the description and drawings of the present application, or direct/indirect applications to other related technical fields are all included in the claimed scope of the present application.

What is claimed is:

1. A signal compensation system, comprising:

a level conversion module for receiving a timing signal and converting the timing signal into a control signal;

a determination module for detecting a target row number of a gate corresponding to the control signal and determining a compensation coefficient according to the target row number; and wherein the determination module further comprises:

a detection unit for detecting a total number of rows of the gates and taking a median value of the total number of rows as the preset row number; and a judgment unit for judging an adjustment state of the control signal according to the target row number and the preset row number and adjusting the compensation coefficient according to the adjustment state;

wherein a compensation module comprises:

a calculation unit for calculating a compensated output voltage according to the compensation coefficient and an output voltage of a preset row; and a compensation unit for sending the compensated output voltage to a corresponding gate, thereby voltages at gates are consistent when the control signal is sent to each of the gates;

wherein the compensated output voltage is a product of the output voltage of the preset row and the compensation coefficient;

a value of the target row number presents a change trend same as that of the compensation coefficient; when the value of the target row number is larger, a wire between the drive circuit and the gate corresponding to the target row number is longer, an impedance of the wire is higher, the compensation coefficient is increased as moving to a row of higher row number.

2. The signal compensation system according to claim 1, wherein the judgment unit is also for:

judging that the adjustment state is to increase when the target row number is larger than the preset row number, taking a first coefficient greater than 1 as the compensation coefficient when judging that the adjustment state is to increase; and judging that the adjustment state is to decrease when the target row number is less than the preset row number, taking a second coefficient less than 1 as the compensation coefficient when judging that the adjustment state is to decrease.

3. A signal compensation method, comprising:

receiving a timing signal and converting the timing signal into a control signal;

detecting a target row number of a gate corresponding to the control signal;

detecting a total number of rows of the gates and taking a median value of the total number of rows as the preset row number;

judging an adjustment state of the control signal according to the total row number and the preset row number;

adjusting a compensation coefficient according to the adjustment state;

calculating a compensated output voltage according to the compensation coefficient and an output voltage of a preset row; and sending the compensated output voltage to a corresponding gate;

wherein the compensated output voltage is a product of the output voltage of the preset row and the compensation coefficient, thereby voltages at gates are consistent when the control signal is sent to each of the gates;

a value of the target row number presents a change trend same as that of the compensation coefficient; when the value of the target row number is larger, a wire between the drive circuit and the gate corresponding to the target row number is longer, an impedance of the wire is higher, the compensation coefficient is increased as moving to a row of higher row numbers.

4. The signal compensation method according to claim 3, wherein the step "judging an adjustment state of the control signal according to the target row number and the preset row number" comprises:

judging that the adjustment state is to increase when the target row number is larger than the preset row number, taking a first coefficient greater than 1 as the compensation coefficient when judging that the adjustment state is to increase; and judging that the adjustment state is to decrease when the target row number is less than the preset row number, taking a second coefficient less than 1 as the compensation coefficient when judging that the adjustment state is to decrease.

* * * * *